US007637324B2

(12) United States Patent
Anderson et al.

(10) Patent No.: US 7,637,324 B2
(45) Date of Patent: Dec. 29, 2009

(54) ISOLATION VALVE FOR SUBSURFACE SAFETY VALVE LINE

(75) Inventors: David Z. Anderson, Glenpool, OK (US); Alan N. Wagner, Broken Arrow, OK (US); Clifford H. Beall, Broken Arrow, OK (US); Anthony S. Coghill, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/773,053

(22) Filed: Jul. 3, 2007

(65) Prior Publication Data

US 2009/0008102 A1 Jan. 8, 2009

(51) Int. Cl.
*E21B 34/00* (2006.01)

(52) U.S. Cl. ..... 166/323; 166/375; 166/321

(58) Field of Classification Search ..... 175/347, 175/318; 166/323, 373, 386, 375, 321; 137/624.27, 137/523
See application file for complete search history.

(56) References Cited

U.S. PATENT DOCUMENTS 3,662,833 A * 5/1972 Kisling, III ..... 166/373
4,067,358 A * 1/1978 Streich ..... 137/624.13
4,072,166 A * 2/1978 Tiraspolsky et al. ..... 137/496
4,387,767 A * 6/1983 Read ..... 166/72
4,403,657 A * 9/1983 Adams, Jr. ..... 166/322
4,531,587 A * 7/1985 Fineberg ..... 166/332.8
4,542,792 A * 9/1985 Akkerman ..... 166/374
5,226,494 A 7/1993 Rubbo et al.
6,213,202 B1 * 4/2001 Read, Jr. ..... 166/55.1
6,427,778 B1 8/2002 Beall et al.
6,957,703 B2 10/2005 Trott et al.
2005/0098325 A1 * 5/2005 Myerley et al. ..... 166/386
2005/0224231 A1 * 10/2005 Surjaatmadja ..... 166/374

OTHER PUBLICATIONS

Hill, T.H., et al., "A New Completion System for Surface-Controlled Subsurface Safety Valves", Journal of Petroleum Technology, Mar. 1974, 331-336.
Raulins, G.M., "Safety by Down-Hole Well Control", Journal of Petroleum Technology, Mar. 1972, 263-271.
Hare, Simon, et al., "MC305 Aconcagua SCSSV Control Hydraulics Problems Uncommanded and SCSSV Closure Problems", SPE 84347, Oct. 2003, 1-7.
Shaughnessy , J.M., et al., "Problems of Ultra Deepwater Drilling", SPE/IADC 52782, Mar. 1999, 1-10.
Berry, S.L., et al., "Deepwater Subsea Valve Flow Assurance-Compatability Between Hydraulic Control Line Fluids and Completion Brines", SPE 96837, Oct. 2005, 1-14.

* cited by examiner

*Primary Examiner*—David J Bagnell
*Assistant Examiner*—Cathleen R Hutchins
(74) *Attorney, Agent, or Firm*—Steve Rosenblatt

(57) ABSTRACT

A valve for a line going to a subsurface safety valve can be blocked off with a valve that is initially held in a closed position. An upper spring pushes collets against a shoulder to keep a seal on a support assembly for the collets within an initial bore in a sealing relation. Application of pressure to the line urges the support assembly to move with respect to the collets and causes the collets to become unsupported. This initial movement of the support assembly is against a second spring that is weaker than the upper spring. The upper spring forces the collapsed collets into a smaller bore while the support assembly is retained against reverse movement at the urging of the second spring by a ratchet assembly. The seal is shifted into a bigger bore to allow flow through the valve and into or beyond the subsurface safety valve.

19 Claims, 1 Drawing Sheet

ISOLATION VALVE FOR SUBSURFACE SAFETY VALVE LINE

FIELD OF THE INVENTION

The field of the invention is downhole tools and more specifically lines connected to subsurface safety valves (SSV) to selectively isolate hydrostatic pressure in the line from valve components.

BACKGROUND OF THE INVENTION

Typically subsurface safety valves use a pivoting valve member biased by a torsion spring on a pivot. The valve member is known as a flapper and is movable by a tube called a flow tube that is actuated to move by a control system that involves one or more control lines running to the body of the valve and outside the production tubing 5 where the valve is mounted. Surface pressure applied in the control line moves an operating piston which is connected to the flow tube. When the flow tube moves down, the flapper is rotated open and the flow tube advances past it to allow flow through the valve body. Upon release or loss of control line pressure a return spring that acts on the flow tube overcomes the control line hydrostatic pressure and forces the flow tube back up to allow the torsion spring to turn the flapper against a seat to keep production fluids from coming through the valve from below.

In the past redundant control line systems have been provided to secrete operating pistons with both operating pistons connected to the flow tube. The rationale was that if one system failed the other would be available to take over and still operate the valve. With two operating pistons each having one end exposed to hydrostatic pressure in its respective control line and both pistons tied into the same flow tube, the hydrostatic pressure acting on the flow tube was additive of the individual hydrostatic pressures in each of the control lines if both control lines are open. This would mean that the size of the return spring would have to take into account the total hydrostatic pressure from both control lines at any time. One way this was addressed before was to use discrete pressurized gas chambers with one exposed to the back side of each of the pistons and the total force they collectively generated was in excess of the combined hydrostatic pressure from multiple control lines.

Another approach to temporarily isolate backup control lines was to put a rupture disc in the backup line to isolate the hydrostatic pressure in that one line from the flow tube and the spring that would ultimately have to close the valve by overcoming hydrostatic pressure in the control lines. With the backup line closed off with a rupture disc the hydrostatic above it did not affect the workings of the valve and the closure spring acting on the flow tube could be sized for the hydrostatic from a single line. There were two main problems with this design. One was that the specific pressure at which the rupture disc will break is not known. The higher the break pressure the wider the range of pressures specified by the rupture disc manufacturer as to when the disc would break. Another issue was that when a disc would break by design it would not always simply split into fragments that remained attached to the disc assembly. At times fragments would break loose and interfere with the operation of downhole components sometimes rendering them inoperable.

The present invention provides a valve to isolate a control line until it is ready for use. It relies on springs whose force is a more reliable quantity than a break pressure on a complex structure such as that of a rupture disc. The valve is initially closed until application of a predictable pressure moves it to the open position. A locking feature can then hold it in the open position. These and other aspects of the present invention will be more apparent to those skilled in the art from a review of the description of the preferred embodiment and the associated drawings with the understanding that the full scope of the invention is measured by the claims.

SUMMARY OF THE INVENTION

A valve for a line going to a subsurface safety valve can be blocked off with a valve that is initially held in a closed position. An upper spring pushes collets against a shoulder to keep a seal on a support assembly for the collets within an initial bore in a sealing relation. Application of pressure to the line urges the support assembly to move with respect to the collets and causes the collets to become unsupported. This initial movement of the support assembly is against a second spring that is weaker than the upper spring. The upper spring forces the collapsed collets into a smaller bore while the support assembly is retained against reverse movement at the urging of the second spring by a ratchet assembly. The seal is shifted into a bigger bore to allow flow through the valve and into or beyond the subsurface safety valve.

DETAILED DESCRIPTION OF THE PREFERRED EMBODIMENT

Figure 1:
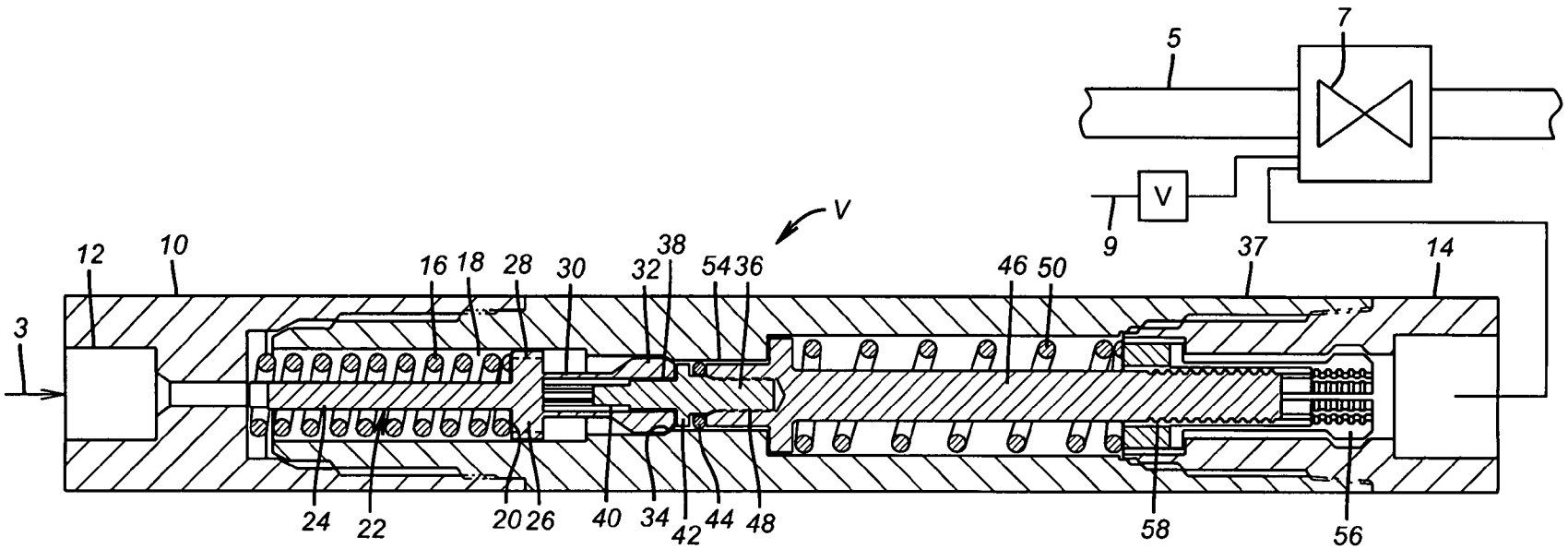
FIG. 1 is a section view of the valve in the closed position.

FIG. 1 illustrates an upper housing 10 with a connection 12 to which a line from the surface (not shown) can be attached. A bottom sub 14 can be connected to the body of the subsurface safety valve for use in operating a flow tube (not shown) or for other services such as a pass though chemical injection passage through the body of the subsurface safety valve. Regardless of the application, the purpose of the valve V between housing 10 and bottom sub 14 is to isolate flow and hydrostatic pressure from behind the valve V when in the closed position of FIG. 1.

Spring 16 is disposed in bore 18 to exert a force against surface 20 of collet assembly 22. Collet assembly 22 features a shaft 24 that goes through spring 16 and that terminates in a base 26 that has longitudinal slots 28 at its outer periphery adjacent bore 18. A plurality of fingers 30 that terminate in collet heads 32 complete the collet assembly 22. The collet heads 32 shoulder against a shoulder 34 in housing 37 that connects upper housing 10 to bottom sub 14. Spring 16 provides the force onto collet heads 32 to keep them initially against shoulder 34.

A collet support member 36 is slidably mounted with respect to heads 32 and has a larger diameter 38 and a smaller diameter 40. Adjacent the larger diameter 38 is a flange 42 that supports a seal 44. Seal 44 is held in position by ratchet rod 46 secured to collet support member 36 at thread 48. Ratchet rod 46 extends through spring 50 which bears on surface 52 of rod 46 in a direction opposed to the force delivered from spring 16. Seal 42 is initially in bore 54, which is located adjacent shoulder 34.

Figure 2:
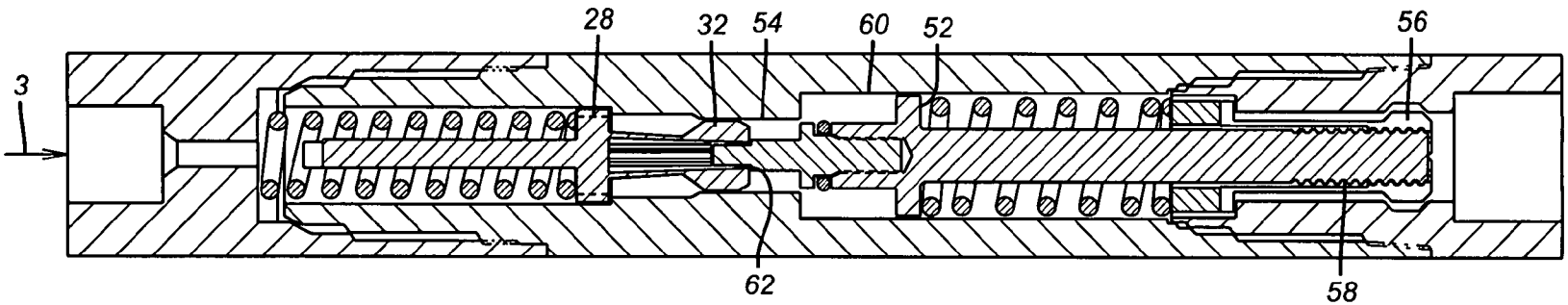
FIG. 2 is the view of FIG. 1 with the valve in the open position.

Bottom sub 14 supports a retention collet 56 which encircles rod 46. Rod 46 has ratchet teeth 58 near its end to allow rod 46 to move in one direction only relative to collets 56. The retained position of rod 46 is shown in FIG. 2.

The parts of the valve V now having been described, the operation will now be reviewed in more detail. In the FIG. 1 position, the seal 44 is in bore 54 to define the closed position. The force from spring 16 forces the collet heads 32 against shoulder 34 and that engagement positions the seal 44 in bore 54 due to spring 50 acting on surface 52 as the landed collet heads 32 are stopped at surface 34 under the force of spring 16. With larger diameter 38 within the collet heads 32 they can't radially inwardly collapse to get into smaller bore 54.

However, when a predetermined pressure is applied at connection 12 with seal 44 in bore 54 a force is applied to collet support member 36 to urge it to move against the force of spring 50. Initially support member 36 moves with respect to the collet heads 32 until surface 40 comes under the collet heads 32 to allow them to radially inwardly collapse to clear surface 34 and to get into bore 54 as shown in FIG. 2. At that point the seal 44 has shifted out of bore 54 and is now in bigger bore 60. Flow now can pass though slots 28 and in the gaps between collet heads 32 in bore 54. The movement of collet support member 36 also causes rod 46 to shift with respect to retention collet 56 and allow the ratchet teeth 58 on rod 46 to push the collets 56 radially out for one way movement. After the applied pressure at connection 12 unseats seal 44, spring 50, which is stronger the hydrostatic pressure at connection 12, tries to move rod 46 in the reverse direction but that motion is stopped by ratchet 56 engaging teeth 58 on rod 46. The valve is now locked in the open position.

Those skilled in the art will appreciate that the force required to open the valve is given by the force to overcome spring 50 a readily determined quantity. Once seal 44 clears bore 54 the stronger spring 16 takes over and overpowers spring 50 to force the collet heads 32 into bore 54 while the smaller diameter 40 of support member 36 is now providing a shoulder 62 on support member 36 onto which the heads 32 transmit the force from stronger spring 16. Weaker spring 50 can't reverse this movement because it is weaker than spring 16 and because the rod 46 is captured by retention collets 56 as an optional backup. A travel stop for rod 46 can occur when spring 50 is bottomed or even sooner by putting a larger diameter or taper on rod 46 above ratchet teeth 58.

In a subsurface safety valve 7 with redundant control lines 3,9 going to individual operating pistons that are connected to a common flow tube, the return spring on the flow tube can be sized for hydrostatic pressure in only one of the lines as the other line or lines can be isolated so that the hydrostatic in those lines does not impact the size of the return spring because only a single line of hydrostatic pressure is exposed to the operating pistons and ultimately the flow tube at a given time. Those skilled in the art can appreciate that the opening pressure can be changed by different sizing of the spring 50. Multiple valves can be used on parallel control lines or other types of lines to open at different pressures. The stronger spring 16 holds the valve open and the retaining collet 56 is an optional backup.

The above description is illustrative of the preferred embodiment and many modifications may be made by those skilled in the art without departing from the invention whose scope is to be determined from the literal and equivalent scope of the claims below.

We claim:

1. A valve assembly for selective isolation of a control line conduit extending parallel to a string connected to a downhole tool, comprising:

at least one housing having a passage therethrough with end connections and a control line running outside the string from at least one of said end connections to the downhole tool;

a movably mounted valve member in said housing and biased by a first biasing member, into a position where said passage is obstructed, said valve member responsive to a predetermined pressure from said control line to open said passage and hold said passage open upon removal of said predetermined pressure for subsequent operation of the downhole tool through said housing with pressure selectively delivered from said control line.

2. The assembly of claim 1, further comprising:

a lock assembly operably connected to said valve member to hold said valve member in position after said valve member shifts to open said passage.

3. The assembly of claim 2, wherein:

said valve member when in a position where said passage is obstructed retains said lock assembly in a position where said valve member is free to move relatively to said lock assembly.

4. The assembly of claim 3, wherein:

predetermined movement of said valve member in a direction to open said passage frees said lock assembly to move.

5. The assembly of claim 4, wherein:

said lock assembly when freed by said movement of said valve member, moves in the same direction as said valve member.

6. The assembly of claim 5, wherein:

a second biasing member urges said lock assembly to move after a predetermined movement of said valve member.

7. The assembly of claim 6, wherein:

said lock assembly comprises at least one collet initially supported against said housing in said passage by said valve member.

8. The assembly of claim 7, wherein:

said housing comprises a shoulder surrounding said passage on which said collet is landed when supported by said valve member.

9. The assembly of claim 8, wherein:

said valve member comprises a first diameter to hold said collet to said shoulder and an adjacent second diameter separated by a second shoulder.

10. The assembly of claim 9, wherein:

relative movement of said valve member with respect to said collet places said second diameter under said collet.

11. The assembly of claim 10, wherein:

said second diameter is smaller than said first diameter.

12. A valve assembly for selective isolation of a conduit extending to a downhole tool, comprising:

a housing having a passage therethrough;

a movably mounted valve member biased by a first biasing member, into a position where said passage is obstructed, said valve member responsive to a predetermined pressure from the conduit to open said passage;

a lock assembly operably connected to said valve member to hold it in position after it shifts to open said passage;

said valve member when in a position where said passage is obstructed retains said lock assembly in a position where said valve member is free to move relatively to said lock assembly;

predetermined movement of said valve member in a direction to open said passage frees said lock assembly to move;

said lock assembly when freed by said movement of said valve member, moves in the same direction as said valve member;

a second biasing member urges said lock assembly to move after a predetermined movement of said valve member;

said lock assembly comprises at least one collet initially supported against said housing in said passage by said valve member;

said housing comprises a shoulder surrounding said passage on which said collet is landed when supported by said valve member;

said valve member comprises a first diameter to hold said collet to said shoulder and an adjacent second diameter separated by a second shoulder;

relative movement of said valve member with respect to said collet places said second diameter under said collet;

said second diameter is smaller than said first diameter;

said second biasing member overcomes said first biasing member to urge said collet against said second shoulder when said second diameter is in contact with said collet.

13. The assembly of claim 12, wherein:

said second biasing member through collet contact with said second shoulder biases said valve member against the opposing force of said first biasing member.

14. The assembly of claim 13, wherein:

said collet, when supported by said second diameter is shifted into a reduced diameter portion of said passage.

15. The assembly of claim 14, wherein:

said reduced diameter portion of said passage is initially closed by a seal in contact with said valve member.

16. The assembly of claim 15, wherein:

said seal shifts into an adjacent enlarged portion of said passage when said valve member is shifted in response to pressure delivered from the conduit.

17. The assembly of claim 16, wherein:

said biasing members comprise coiled springs; and a backup locking member for said valve member.

18. The assembly of claim 17, wherein:

said backup locking member further comprises serrations on said valve member that come into alignment with at least one retention collet after said valve member moves enough to get said seal out of said reduced diameter portion of said passage.

19. A valve assembly for selective isolation of a control line conduit extending parallel to a string connected to a downhole tool, comprising:

at least one housing having a passage therethrough with end connections and a control line running outside the string from at least one of said end connections to the downhole tool;

a movably mounted valve member in said housing and biased by a first biasing member, into a position where said passage is obstructed, said valve member responsive to a predetermined pressure from said control line to open said passage;

said housing and said control line are connected to one of a plurality of control system connections on the downhole tool which further comprises a single subsurface safety valve;

said valve member when obstructing said passage in said housing isolating hydrostatic pressure in said conduit connected to said conduit's respective housing from affecting operation of a control system in the subsurface safety valve.

* * * * *